United States Patent [19]

LaValle

[11] 4,438,581

[45] Mar. 27, 1984

[54] BENCH REST DEVICE FOR HANDGUNS

[76] Inventor: Bernard A. LaValle, 627 E. Queen Ave., Spokane, Wash. 99207

[21] Appl. No.: 380,413

[22] Filed: May 20, 1982

[51] Int. Cl.[3] ..... F41C 29/00

[52] U.S. Cl. ..... 42/94

[58] Field of Search ..... 42/94; 89/37 BA

[56] References Cited

U.S. PATENT DOCUMENTS

| | | | |
|---|---|---|---|
| 882,988 | 3/1908 | Aloyos et al. | 42/94 |
| 1,089,307 | 3/1914 | Benet et al. | 42/94 |
| 2,847,909 | 8/1958 | Kester | 42/94 |
| 3,156,062 | 11/1964 | Stevenson et al. | 42/94 |
| 3,608,225 | 9/1971 | Manuel | 42/94 |
| 3,608,852 | 9/1971 | Horn | 42/94 |
| 3,827,172 | 8/1974 | Howe | 42/94 |
| 4,007,554 | 2/1977 | Helmstadter | 42/94 |
| 4,026,057 | 5/1977 | Cady | 42/94 |
| 4,207,699 | 6/1980 | Hensley | 42/94 |

*Primary Examiner*—Charles T. Jordan

[57] ABSTRACT

An adjustable support device for handguns which includes primarily an inclined surface for handgun butt support and fine sighting adjustment, a yoked shaft within a sleeve for handgun barrel support and approximate sighting adjustment, a vertical surface for additional stability of the shooter's hand and a three point base for support of the entire device and stability upon a surface.

1 Claim, 2 Drawing Figures

BENCH REST DEVICE FOR HANDGUNS

FIELD OF INVENTION

My invention relates generally to supports for firearms to aid aiming and firing and more particularly to an improved bench rest device for handguns.

DESCRIPTION OF PRIOR ART

Although handguns are designed to be held and fired by a shooter without benefit of secondary support, it has long been recognized that shooting accuracy may be enhanced by use of a mechanical support substantially independent of the shooter, preferably one that bears the weight of the handgun and maintains it in firing position. Heretofore, the shooter would need to carry sandbags to the shooting site or clamp the handgun into a vice-like device with mechanical adjustments. None of the aforementioned methods of benchrest shooting provide for quick sighting alignment, ease of use or convenient transport.

OBJECTS

Accordingly, the principal object of my invention is to provide a bench rest device which will enable the shooter to attain quick and accurate sighting alignment without the use of sandbags or other bulky or mechanically complex equipment.

Another object of this invention is to provide a bench rest device with an inclined surface which supports the handle end of the handgun, with fine elevational sighting adjustments being facilitated by longitudinal sliding movement of the handgun on the inclined surface, thus raising or lowering the sighting line of the gun as will become evident in FIG. 2 herewith.

Another object of my invention is to provide a bench rest device which will support the entire gun and will also give support to the hands of the shooter.

A still further object of my invention is to provide a bench rest device which will have a three point base which will give lateral stability, the base including sleeve and shaft means for supporting the rubber cushioned yoke member that supports the fore-end or barrel of the handgun.

Other objects of my invention are to provide a bench rest for handguns which will be simple in design, inexpensive to manufacture, rugged in construction, easy to use and efficient in operation.

Further objects and advantages of my invention will become apparent from a consideration of the drawings and ensuring description thereof.

BRIEF DESCRIPTION OF THE DRAWINGS

In the accompanying drawings which form a part hereof and wherein like numbers of references refer to the same parts throughout.

DESCRIPTION OF THE PREFERRED EMBODIMENT

Figure 1:
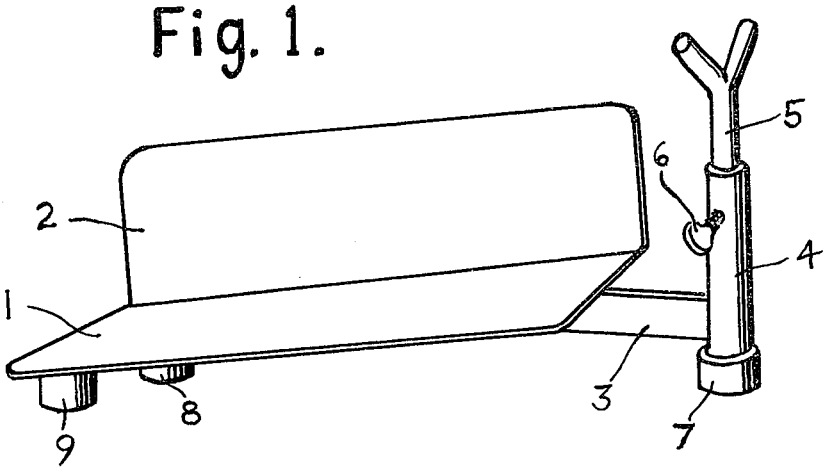
FIG. 1 is a perspective view of my invention showing the various parts, their configuration and relationship.

Referring now to FIG. 1 of the drawings it will be seen that my invention is shown to include a rubber coated flat metal plate inclined surface 1 securedly affixed to a vertical rubber coated flat metal side plate 2. Extending from the elevated end of the inclined surface and securedly affixed thereto is a metal crossbar 3 which is securedly affixed to a metal sleeve 4 which carries a metal rubber coated yoke 5. A set screw 6 carried by sleeve member 4 provides locking means so as to lock adjustable yoke member 5 into desired position. Metal feet members 7, 8 and 9 are affixed securedly to sleeve member 4 and inclined surface member 1 respectively and are coated with rubber, neopreme or other suitable cushioning substance.

While the above description contains many specificities, these should not be construed as limitations on the scope of the invention, but rather as an exemplification of one preferred embodiment thereof. Many other variations are possible, for example it could be constructed of plastic rather than metal, or the angle of the inclined surface could be made adjustable. Accordingly, the scope of the invention should be determined not by the embodiment illustrated, but by the appended claims and their legal equivalents.

Figure 2:
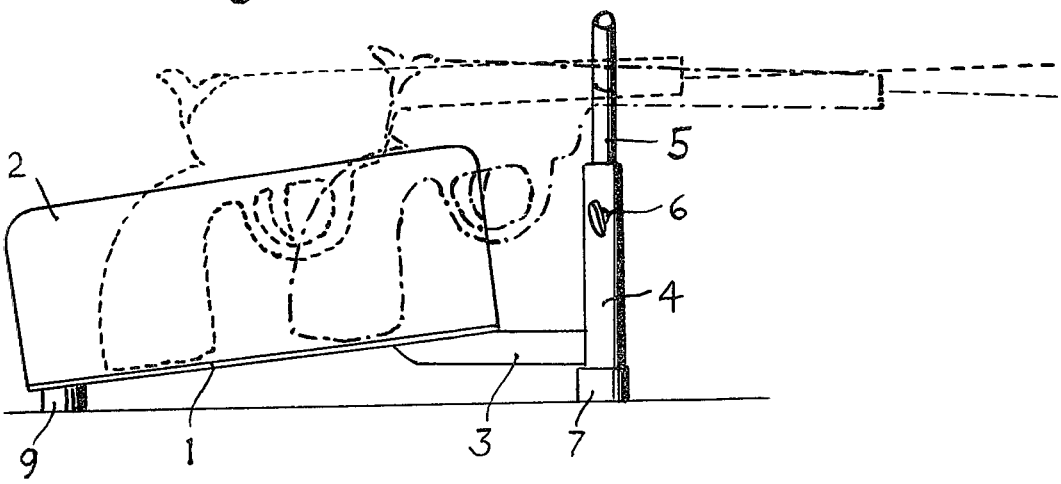
FIG. 2 is a side elevation of my invention showing a handgun drawn in phantom lines. The handgun is shown in two positions in order to illustrate how the sighting line is raised or lowered by sliding the butt of the handgun forward or backward on the inclined surface of my invention.

Having thusly described my invention, it's operation may now be understood. Please refer to FIG. 2. In use, the butt or handle of the handgun is supported by the inclined surface member 1 while the barrel of the handgun is supported by the yoke member 5. The yoke member 5 is adjusted for approximate up-down sighting alignment on target and made secure by use of set screw member 6. Shooter then holds handgun in normal shooting position while handgun rest device supports weight of gun. Fine sighting is achieved by sliding the gun forward or backward on the inclined surface member 1, thus raising or lowering the sighting alignment slightly. Further stability is given to the shooter's hand by contact with the vertical metal plate member 2.

Having thusly described my invention, what I desire to protect by Letters Patent, and what I claim is:

1. A bench rest device for handguns comprising:

(a) a rigid, rectangular, inclined surface base having top and bottom surfaces and front and rear ends;

(b) a vertical surface affixed along the side edge of said inclined surface;

(c) a sleeve securely affixed to the center of the raised end of said inclined surface;

(d) a sliding yoked shaft within said sleeve, secured by means of a set screw; and (e) tripodal feet portions for stability upon a surface.

* * * * *